US006354316B1

(12) United States Patent
Chen

(10) Patent No.: US 6,354,316 B1
(45) Date of Patent: Mar. 12, 2002

(54) SKELETON FOR UMBRELLA TENT

(76) Inventor: Shih-Ching Chen, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/541,607

(22) Filed: Apr. 3, 2000

(51) Int. Cl.[7] ..... E04H 15/24

(52) U.S. Cl. ..... 135/100; 135/121; 135/139; 135/147; 135/128; 135/98; 248/188.5; 248/188.6; 248/188.7; 248/170

(58) Field of Search ..... 135/100, 121, 135/139, 141, 143, 147, 151, 128, 98; 248/177.1, 188.5, 188.6, 188.7, 170, 434

(56) References Cited

U.S. PATENT DOCUMENTS

RE16,037 E * 3/1925 Berg ..... 135/147 X
5,876,011 A * 3/1999 Blasing ..... 248/411
5,934,628 A * 8/1999 Basnakovic ..... 248/177.1

* cited by examiner

*Primary Examiner*—Robert Canfield

(57) ABSTRACT

A skeleton for umbrella tent mainly includes a top hub to which multiple brace poles are radially and pivotally connected to stretch by a predetermined angle; a bottom hub to which multiple stretch arms are radially and pivotally connected to stretch by a predetermined angle, and outer ends of these stretch arms are separately pivotally connected to a predetermined point on the brace poles; a flexible telescopic portion located between the top and the bottom hubs and consisting of multiple sections in the form of hollow truncated cones; and a pull rope extending through the telescopic portion with an upper end fixed to the top hub and a lower end hanging from the bottom hub to connect to a ring handle. By pulling the pull rope downward, the telescopic portion is folded to easily cause the stretch arms and the brace poles to move into a stretched position to set up the tent.

2 Claims, 7 Drawing Sheets

SKELETON FOR UMBRELLA TENT

BACKGROUND OF THE INVENTION (1) Field of the Invention

The present invention relates to a skeleton for umbrella tent, and more particularly to an umbrella tent skeleton that includes a flexible and telescopic portion that guides an operator to easily stretch the tent, and brace poles that may be folded by large angle into a collapsed position.

(2) Description of the Prior Art

Conventional umbrella tents may be generally divided into three types, a first type of which is shown in FIG. 4 and has an externally stretched skeleton. This type of conventional umbrella tent skeleton includes a top hub 12' to which multiple brace poles 11' are pivotally connected to radially stretch by a predetermined angle, and a bottom hub 14' to which inner ends of multiple stretch arms 15' are pivotally connected to radially stretch by a predetermined angle and outer ends of the stretch arms 15' are pivotally connected to a predetermined point on the brace poles. A guide rod 13' extends through the top and the bottom hubs 12' and 14' such that the whole skeleton may be stretched like an umbrella skeleton by pulling the guide rod 13' upward. In this type of umbrella tent skeleton the guide rod 13' helps an operator to apply force correctly to stretch the tent more quickly. The guide rod 13' is, however, located at a top of the tent and exposed to external environment, and is therefore subject to dangerous lightning strike. Moreover, the guide rod 13' is in the form of a rigid stick that tends to bend or break if a force is improperly applied thereto to stretch the tent. A further disadvantage of this type of umbrella tent skeleton is that the brace poles 11' are not foldable and would occupy a very large space even when the tent has been collapsed.

The second type of conventional umbrella tent is shown in FIG. 5. The skeleton of this type of tent includes a top hub 4 to which multiple brace poles 17 are pivotally connected to radially stretch by a predetermined angle, and a bottom hub 7 to which inner ends of multiple stretch arms 15 are pivotally connected to radially stretch by a predetermined angle and outer ends of the stretch arms 15 are pivotally connected to a union on the brace poles 17. The bottom hub 7 is slidably moved along a guide rod 8 that extends between the top and the bottom hubs 4 and 7. A spring lock 14 is provided on the bottom hub 7 to lock the bottom hub 7 in place on the guide rod 8 when the bottom hub 7 has been moved to a position to fully stretch the tent. The brace pole 17 each has a coupler 9 connected to an outer end for pivotally connecting an extension pole 18 thereto, so that the brace pole 17 has an extended working length. In this second type of umbrella tent skeleton the guide rod 8 helps an operator to apply force correctly to stretch the tent more quickly and is located inside the tent without the risk of dangerous lightning strike. However, the guide rod 8 is in the form of a rigid stick that tends to bend or break if a force is improperly applied thereto to stretch the tent. Moreover, the brace poles 17 and the extension poles 18 could be pivotally bent at the couplers 9 by about 180 degrees only. The extension poles 18 could be bent within the limited angle only in one direction, and would very possibly break if it is over bent or bent in a wrong direction.

FIGS. 6 and 7 shows the third type of conventional umbrella tent that includes a top hub 11A to which inner ends of multiple brace poles 141 are pivotally connected via first pivotal joints 131, and a bottom hub 12A to which inner ends of multiple stretch arms 142 are pivotally connected via second pivotal joints 133. An outer end of each brace pole

141 is provided with a support 135 and a coupler 136 to which an extension pole 143 is pivotally connected. An outer end of each stretch arm 142 is provided with a third joint 134 for pivotally connecting the stretch arm 142 to a union 132 on the brace pole 141. The bottom hub 12A has an insert 12A1 through which a pull rope 21 is threaded to extend between the top and the bottom hubs 11A, 12A and replace the conventional rigid guide rod. When the pull rope 21 is pulled upward from the top hub 11A, the skeleton is stretched. FIG. 7 illustrates a fully stretched tent of this third type. In this third type of conventional tent, the rigid guide rod is omitted and the problem of a broken guide rod is avoided. However, since an umbrella tent usually includes a very large skeleton that could not be easily stretched simply by pulling the unsteady pull rope 21. And again, the extension poles 143, like that in the second type of conventional tent, could be pivotally bent only within a limited angle and are therefore subject to easy break if a force is improperly applied to bend the extension poles. The tent of this type could not be easily stretched particularly when the operator is a child and not high enough to touch the pull rope 21 or bend the extension poles at proper points.

It is therefore desirable to develop an improved skeleton for umbrella tent to eliminate the drawbacks existing in the conventional umbrella tents.

SUMMARY OF THE INVENTION

A primary object of the present invention is to provide an improved umbrella tent skeleton that mainly includes a top hub to which multiple brace poles are radially and pivotally connected to stretch by a predetermined angle; a bottom hub to which multiple stretch arms are radially and pivotally connected to stretch by a predetermined angle, and outer ends of these stretch arms are separately pivotally connected to a predetermined point on the brace poles; a flexible telescopic portion located between the top and the bottom hubs and consisting of multiple sections in the form of hollow truncated cones; and a pull rope extending through the telescopic portion with an upper end fixed to the top hub and a lower end hanging from the bottom hub to connect to a ring handle. By pulling the pull rope downward, the telescopic portion is folded to easily cause the stretch arms and the brace poles to move into a stretched position to set up the tent.

The telescopic portion of the skeleton has the function of a guide rod to guide an operator to apply force correctly in stretching the tent. Moreover, the telescopic portion forms a flexible long member that can be conveniently operated and would not be easily bent or broken due to improperly applied force to it. The telescopic portion is therefore very suitable for a large-scaled tent.

Another object of the present invention is to provide an umbrella tent skeleton that includes a coupling structure for pivotally connecting an extension pole to a brace pole, such that the extension pole could be bent relative to the brace pole by 360 degrees in forward or reverse direction to avoid the problem of a broken extension pole. The coupling structure for this purpose includes tenons provided on opposite sides of the brace and the extension poles near their outer and inner ends, respectively, and a coupler provided at opposite sides of each end with two sliding slots. The coupler is connected to and between two adjacent brace pole and extension pole by engaging the tenons into the sliding slots, so that the two poles may be locked into an extended position or be released to pivotally bend by 360 degrees into a folded position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
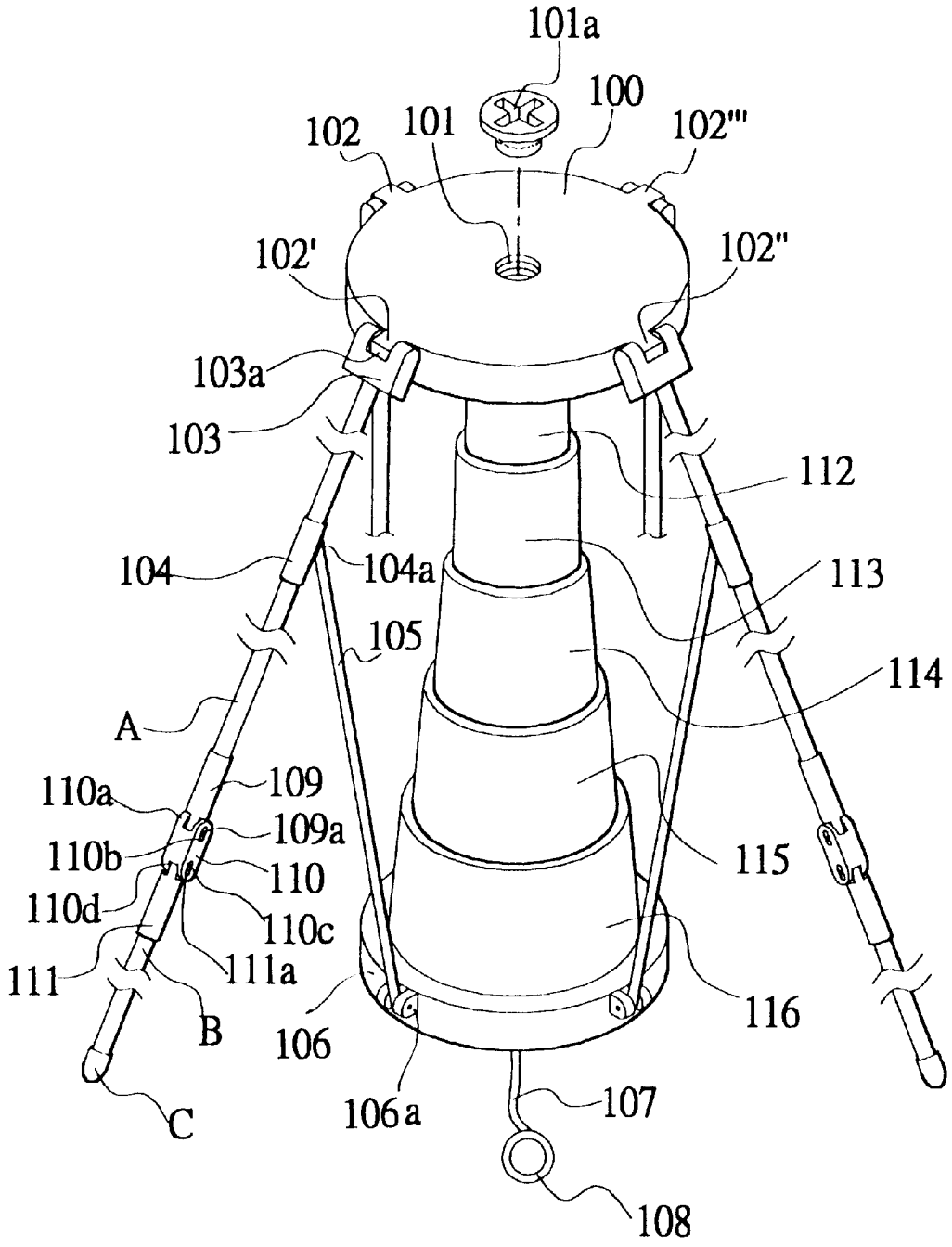
FIG. 1 is a schematic and fragmentary perspective of an umbrella tent skeleton according to the present invention.
Figure 2:
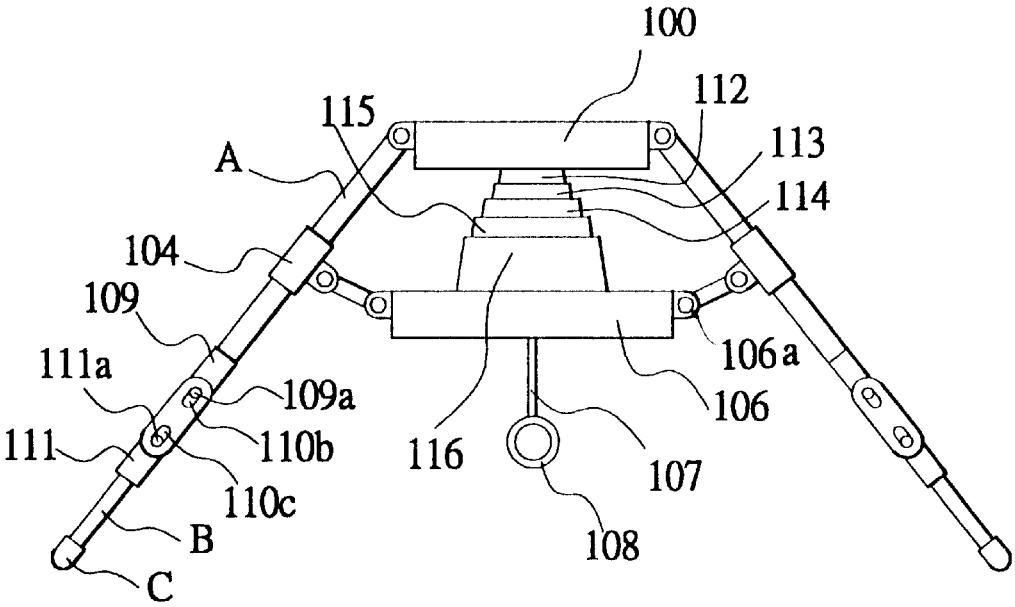
FIG. 2 is an elevational view of the umbrella tent skeleton of FIG. 1 in a stretched state.

Please refer to FIG. 1 that is a schematic and fragmentary perspective of a skeleton for an umbrella tent according to the present invention. As shown, the skeleton mainly includes a top hub 100, a bottom hub 106, a telescopic portion consisting of multiple sections 112, 113, 114, 115 and 116 located between the top and the bottom hubs, multiple stretch arms 105 (four are shown in the illustrated drawings), and multiple brace poles A and extension poles B corresponding to the stretch arms in number.

The top hub 100 is provided at a center with a threaded through hole 101 into which a fastening means, such as a screw 101*a* is tightened. A pull rope 107 having a ring handle 108 connected to a lower end thereof and extending through the telescopic portion is connected at an upper end to the screw 101a. Four radially projected lugs 102 are equally spaced around an outer periphery of the top hub 100, to each of the four lugs 102 a joint 103 is pivotally connected by engaging the lug 102 into a mating notch 103*a* on the joint 103. The joint 103 each is connected at an outer end opposite to the mating notch 103*a* to an inner end of one brace pole A, so that the brace pole A is pivotally movable relative to the top hub 100.

The bottom hub 106 has four radially projected brackets 106*a* equally spaced around an outer periphery of the bottom hub 106 corresponding to the four lugs 102 on the top hub 100. Each of the brace poles A is provided at a predetermined point with a union 104 that has a radially inward faced pivotal joint 104*a*. Each of the stretch arms 105 is pivotally connected at an inner end to one of the brackets 106*a* and at an outer end to the pivotal joint 104*a* on a corresponding brace pole A.

The sections 112 thru 116 constituting the telescopic portion are in the form of hollow truncated cones. Each of the hollow truncated cones is provided with means, such as a radially outward projected flange around a lower outer periphery and a radially inward projected flange around an upper inner periphery (not shown), so that any one smaller truncated cone would not undesirably slide out of one adjacent larger truncated cone from a top of the latter to therefore allow the telescopic portion to be freely stretched or collapsed. When all the sections of hollow truncated cones 112 thru 116 of the telescopic portion are in their fully stretched position, a flexible long member is provided.

Sleeves 109 and 111 are respectively provided around an outer end of each brace pole A and an inner end of each extension pole B at where the brace pole A and the extension pole B are connected to each other. The sleeves 109 and 111 are provided near their joint at two opposite sides with tenons 109*a* and 111*a*, respectively. A coupler 110 having two ends formed of two notches 110*a* and 110*d* is positioned between the sleeves 109 and 111. The coupler 110 each is provided near both ends at two opposite sides thereof with two sliding slots 110*b* and 110*c* into which the tenons 109*a* and 111*a*, respectively, are engaged. The notches 110*a* and 110*d* are so sized that they allow the sleeves 109 and 111, and accordingly the brace pole A and the extension pole B, to pivotally turn by 360 degrees relative to the coupler 110. A cap C may be mounted to an outer end of each extension pole B that frequently frictionally contacts with the ground.

The telescopic portion included in the umbrella tent skeleton of the present invention is in the form of a flexible long member when the skeleton is in a folded state. Such a flexible telescopic portion has the function of guiding an operator to apply force in a correct direction to stretch the whole skeleton and is not subject to easy break when stretching the skeleton.

Figure 3:
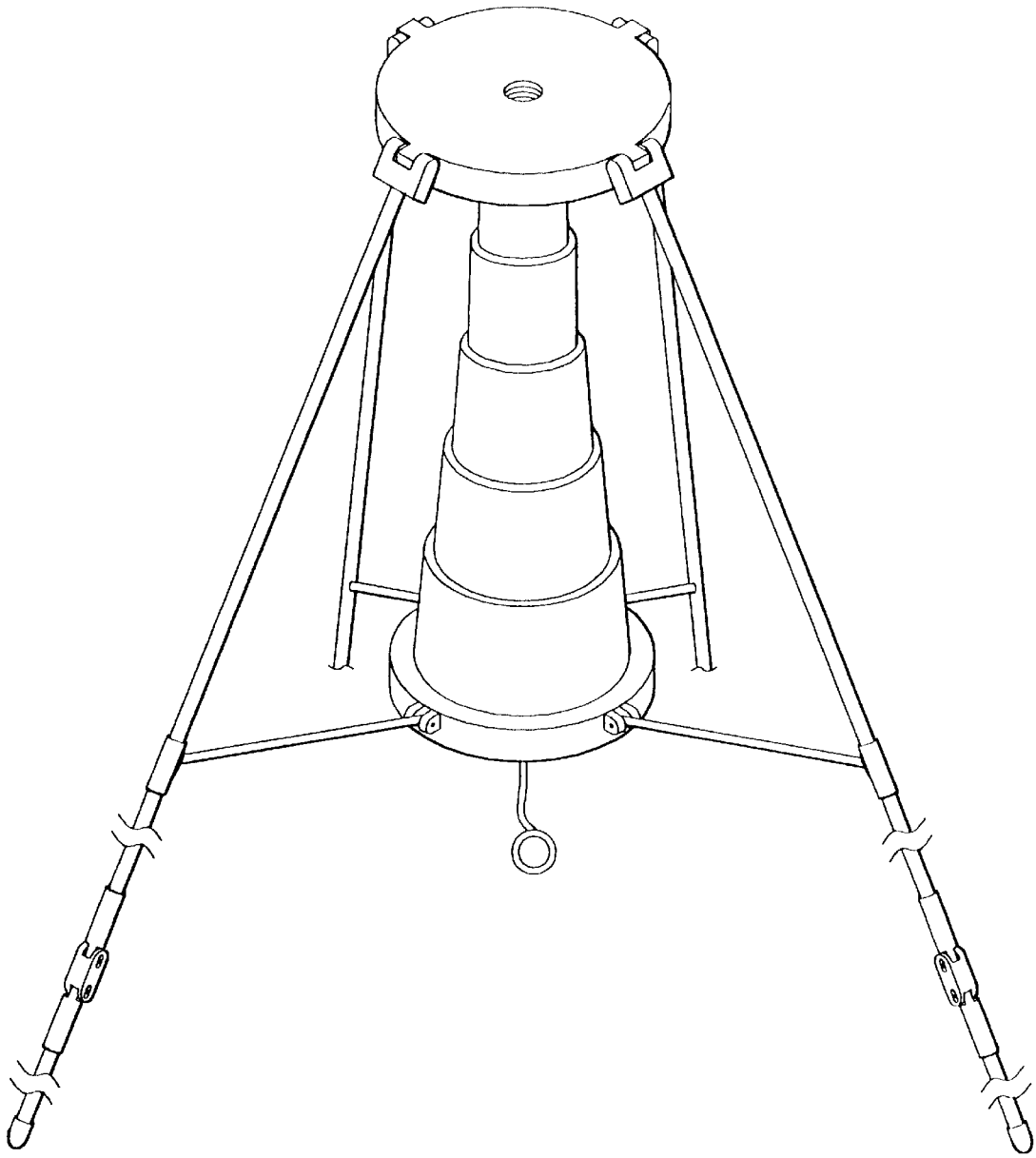
FIG. 3 is a fragmentary perspective of the umbrella tent skeleton of FIG. 1 in a fully stretched state.
Figure 4:
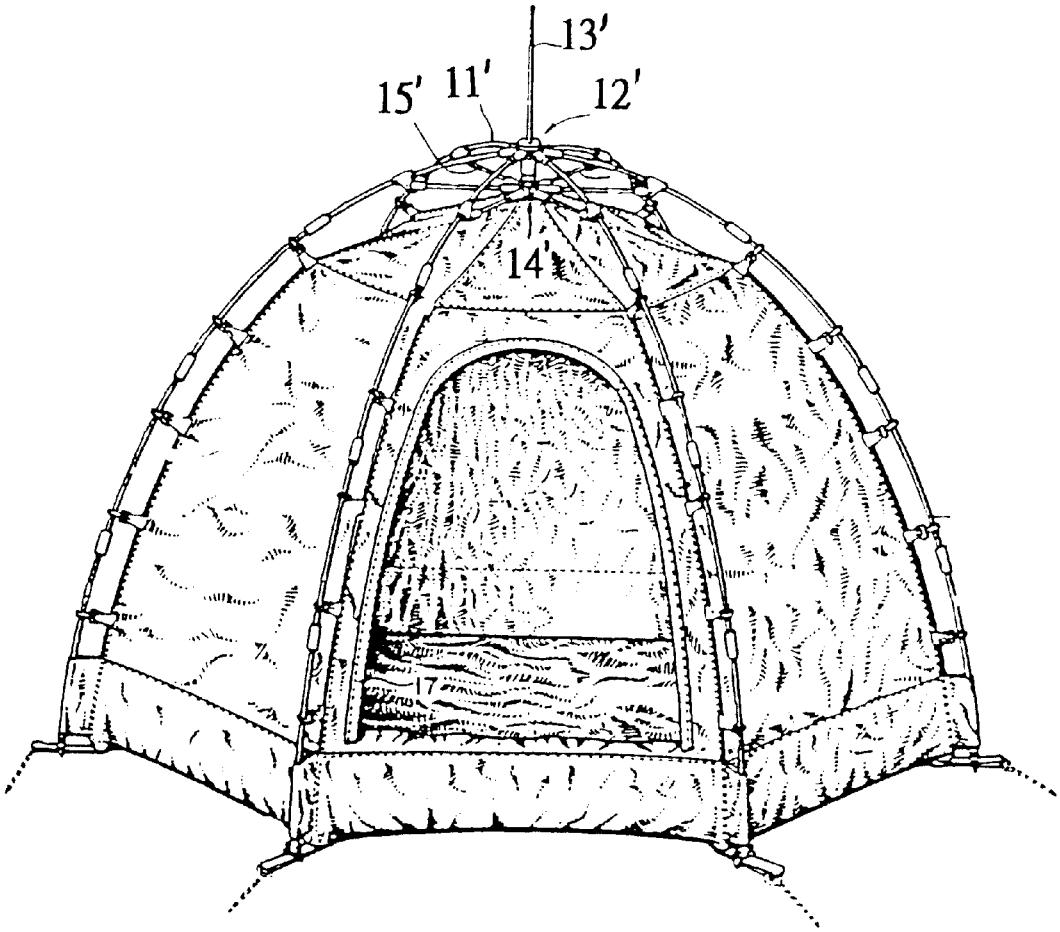
FIG.4 Prior Art
FIG. 4 shows the skeleton of a first type of conventional umbrella tent.
Figure 5:
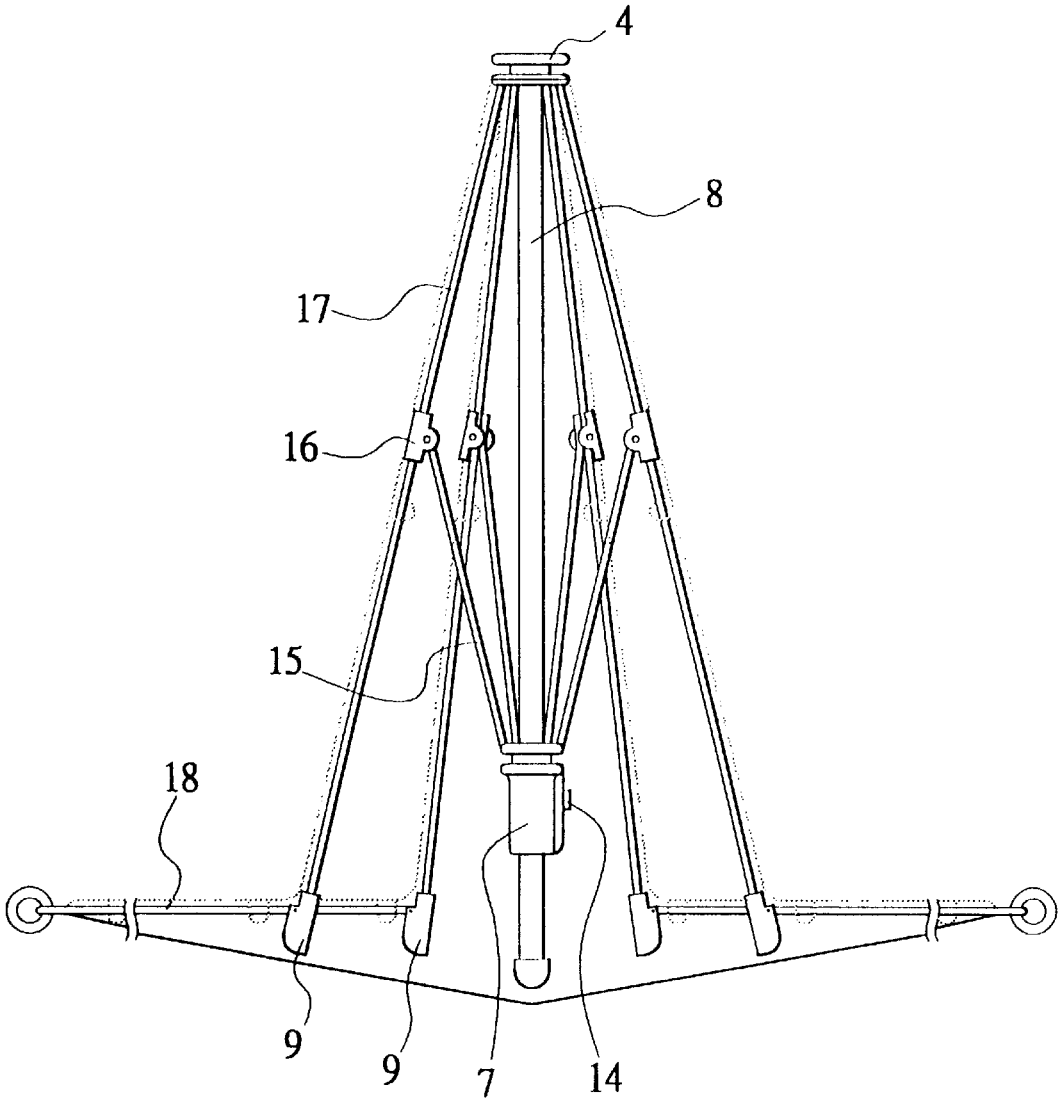
FIG.5 Prior Art
FIG. 5 shows the skeleton of a second type of conventional umbrella tent.
Figure 6:
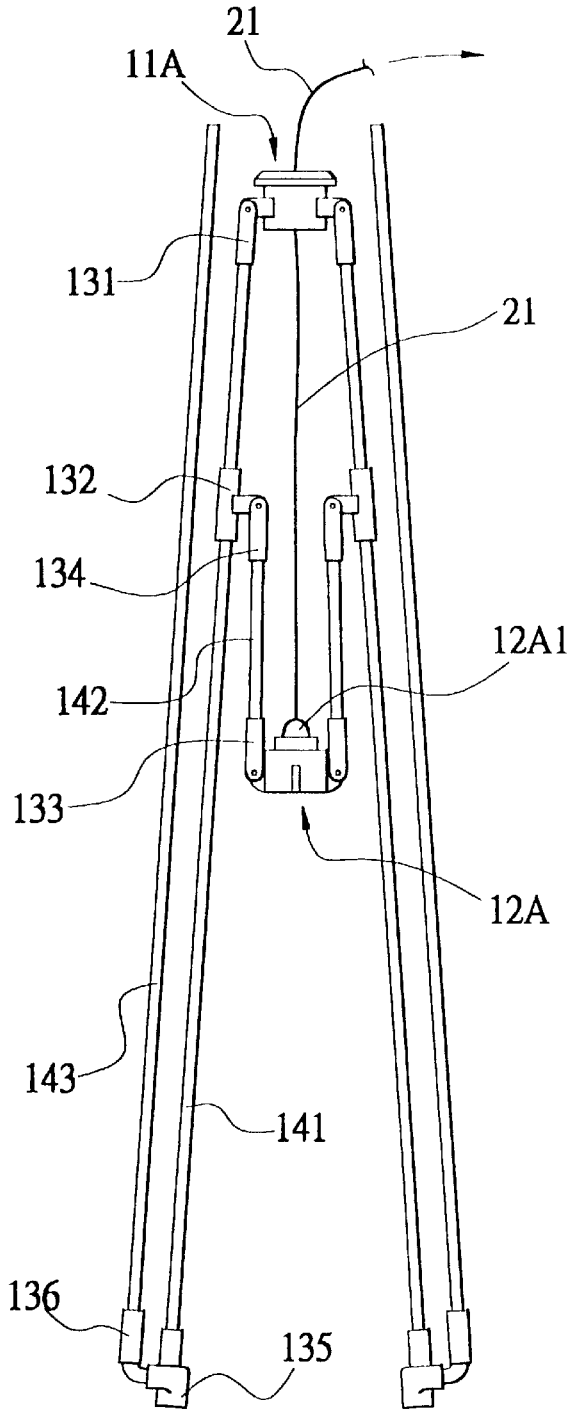
FIG.6 Prior Art
FIG. 6 shows the skeleton of a third type of conventional umbrella tent.
Figure 7:
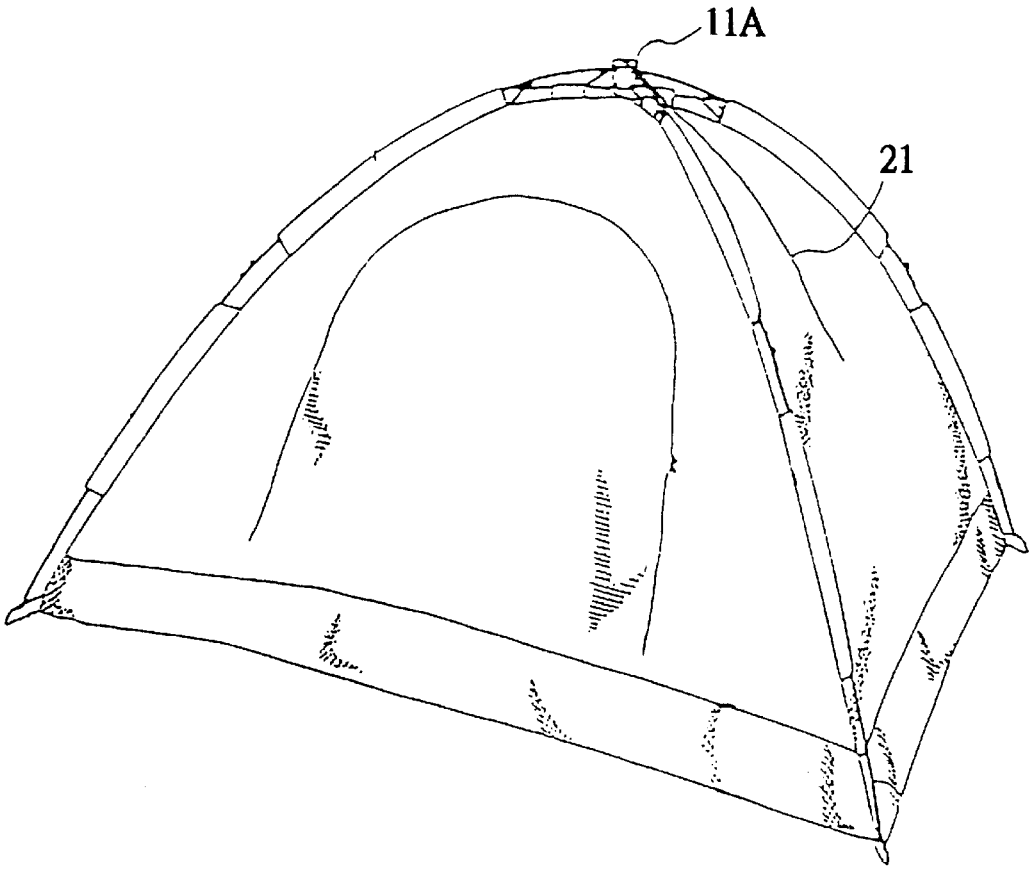
FIG.7 Prior Art
FIG. 7 shows the appearance of the third conventional umbrella tent of FIG. 6 in a fully stretched state.

By downward pulling the pull rope 107 at the ring handle 108, the sections 112 thru 116 of the telescopic portion are brought into a nested state while the stretch arms 105 are pushed outward to stretch the brace poles A. And then, the extension poles B could be brought into an extended position by turning the extension poles B relative to the brace poles A until the tenons 109*a* and 111*a* are locked in the sliding slots 110*b* and 110*c*. FIG. 3 shows a fully stretched skeleton of an umbrella tent according to the present invention.

The following are some advantages of the present invention:

1. The telescopic portion serves as a guide rod to guide an operator to apply force correctly to stretch the umbrella tent and is flexible to avoid easy break thereof.
2. The telescopic portion is length-adjustable and therefore facilitates folding of the whole umbrella tent into a considerably small volume for convenient transport and storage.
3. The extension poles B are pivotally turnable by 360 degrees relative to the brace poles A. This allows the operator to selectively bend the extension poles B by different angles depending on actual need. The extension poles B in a folded position are not subject to easy break and allow the tent to be moved more conveniently.
4. The extension poles B are not necessarily limited to a one-section member. They may be of multi-section members to function equally well as the one-section members while allow an even larger tent to be set up.

What is claimed is:

1. A skeleton for umbrella tent comprising a top hub, a bottom hub, multiple brace poles pivotally connected at inner ends to an outer periphery of said top hub at equal space that said brace poles are allowed to radially stretch by a predetermined angle, multiple stretch arms corresponding to said brace poles in number and pivotally connected at inner ends to an outer periphery of said bottom hub and at outer ends to predetermined points on the brace poles that said stretch arms are allowed to radially stretch by a predetermined angle, and a pull rope fixedly connected at an upper end to said top hub and at a lower end to a ring handle; said skeleton for umbrella tent being characterized in that a telescopic portion is positioned between and fixed at two ends to said top and said bottom bubs, said telescopic portion consisting of a set of sections in the form of hollow truncated cones, said sections each being provided with means of a radially outward projected flange around a lower outer periphery and a radially inward projected flange around an upper inner periphery, so that any one section of smaller truncated cone does not undesirably slide out of one adjacent section of larger truncated cone from a top of the latter and accordingly allows said telescopic portion to be freely stretched or collapsed through control of said pull rope that extends through said telescopic portion, and that an extension pole is pivotally connected at an inner end to an outer end of each said brace pole by engaging tenons provided on said inner and said outer ends of said extension poles and said brace poles, respectively, into sliding slots provided on a coupler disposed between said extension and said brace poles, that said extension poles can be either locked into an extended position from said brace poles or pivotally bent by 360 degrees into a folded position to abut on said brace poles.

2. A skeleton for umbrella tent as claimed in claim 1, wherein each of said extension poles includes more than one section sequentially pivotally connected to one another with said coupler and said tenons.

* * * * *